US006497791B1

(12) United States Patent
Baker

(10) Patent No.: US 6,497,791 B1
(45) Date of Patent: Dec. 24, 2002

(54) APPARATUS FOR PRE-TREATMENT OF WOOD CHIPS

(75) Inventor: Jack T. Baker, Greenwich, NY (US)

(73) Assignees: Jack T. Baker, Glens Falls, NY (US); Myles M. Miller, Glens Falls, NY (US)

( * ) Notice: Subject to any disclaimer, the term of this patent is extended or adjusted under 35 U.S.C. 154(b) by 0 days.

(21) Appl. No.: 09/942,500

(22) Filed: Aug. 30, 2001

(51) Int. Cl.[7] ..... D21C 7/06; D21C 7/08

(52) U.S. Cl. ..... 162/246; 162/68; 162/250; 34/582; 34/583; 34/585

(58) Field of Search ..... 162/19, 68, 250, 162/241, 246; 34/57, 168, 171, 182, 582, 583, 585, 58

(56) References Cited

U.S. PATENT DOCUMENTS

| | | | |
|---|---|---|---|
| 2,227,634 A | 1/1941 | Dalin | 83/28 |
| 3,801,431 A | 4/1974 | Ingemarsson | 162/19 |
| 4,454,661 A | 6/1984 | Klein et al. | 34/57 E |
| 4,930,230 A | 6/1990 | Weckherlen et al. | 34/168 |

FOREIGN PATENT DOCUMENTS

| | | |
|---|---|---|
| EP | 472820 | 5/1991 |

*Primary Examiner*—Dean T. Nguyen
(74) *Attorney, Agent, or Firm*—Drinker Biddle & Reath LLP

(57) ABSTRACT

A pre-treatment device for wood chips for pulping comprises a tube through which the wood chips fall into a digester. Steam is injected into the tube through rings of nozzles, which are angled circumferentially to impart a rotary and turbulent motion to the falling chips. Some nozzles are angled downwardly to encourage the chips to flow freely through the tube, some are horizontal to encourage a longer dwell time near the nozzles. Digesting liquor is also sprayed onto the chips from spray nozzles after the first ring of steam nozzles. The heat and steam expel air and other non-condensable gases and volatiles from the chips, allowing them to absorb the liquor. At the bottom of the tube, the chips are propelled down and outwards by jets of higher-pressure steam, spreading and packing them into the digester.

13 Claims, 9 Drawing Sheets

APPARATUS FOR PRE-TREATMENT OF WOOD CHIPS

FIELD OF THE INVENTION

The invention relates to the treatment of loose material with liquid and/or vapor. The invention relates in particular to the digestion of wood chips to produce pulp from which paper can be made, and in particular to a device and method for pre-treating the wood chips that are being loaded into the digester.

BACKGROUND OF THE INVENTION

One method of producing wood pulp for paper-making comprises reducing wood to chips, and digesting the wood chips to pulp (by exposing them to steam and cooking liquor) at elevated temperature and pressure. Cooking liquor is heated to approximately 350° F. (180° C.), and a pressure of around 150 psi (1 MPa) is maintained to insure the liquor maintains temperature. The cooking liquor is circulated throughout the digester, which dissolves the organic and non-organic material in the cellulose material. This action results in a slurry consisting of cellulose fiber. The slurry is then cleaned and dewatered, which results in a product used for making paper. It has been found that the effectiveness and efficiency of the digestion process can be improved by pre-treatment of the wood chips before they are loaded into the digester.

SUMMARY OF THE INVENTION

According to one aspect of the invention, there is provided a pre-treatment unit designed to be installed in the wood chip conveying system, between a wood chip conveyor and an inlet that is located on top of the wood chip digester, or of any vessel that is used for processing wood chips. According to another aspect of the invention, there is provided a method of pre-treating wood chips using such a unit. According to further aspects of the invention, the pre-treatment unit and method may be used with particulate materials other than wood-chips and/or for other purposes.

A pre-treatment unit according to one aspect of the invention comprises a tube having an inlet for chips at an upper end and an open lower end forming an outlet for pre-treated chips. At least one ring of injection nozzles in the wall of the tube admits into the tube flows of gas or vapor angled circumferentially to impart a rotating motion to said chips. The chips are permitted to fall freely from the inlet to and through the outlet while being exposed to the gas or vapor.

Where the pre-treatment unit is intended to pre-treat wood chips for pulping, the gas or vapor is usually steam. A suitable supply of steam at the temperatures and pressures required is then preferably provided.

Preferably, there are several rows of steam injection nozzles, grouped into steam injectors spaced apart along the length of the unit. The nozzles in the bottom row of each unit are then preferably angled slightly downwards so as to urge the chips to flow down to the next injector, while the nozzles in the top row of each subsequent injector are horizontal, to encourage the chips to dwell within the steam injector, where they are most subject to the action of the injected steam.

Preferably, there is also a row of liquor injection nozzles, spraying digestive liquor onto the chips between two of the steam injectors.

The combined action of the heat and moisture in the steam has been found not only to preheat the wood chips but also to de-aerate them, replacing the air and non-condensable vapor in the pores of the wood chips with water or digestive liquor.

Preferably, at the bottom of the pre-treatment unit, the chips are propelled down and outwards by high pressure steam. This can serve both to compact the wood chips and to spread them evenly over the plan area of the digester.

By pre-heating, de-aerating, and compacting the wood chips, it is possible to realize an increase of wood chip throughput of between 15–18 percent per batch, a reduced cooking cost, and an improvement in pulp quality.

BRIEF DESCRIPTION OF THE DRAWINGS

For the purpose of illustrating the invention, there are shown in the drawings forms of the invention which are presently preferred; it being understood, however, that this invention is not limited to the precise arrangements and instrumentalities shown.

DETAILED DESCRIPTION OF THE DRAWINGS

Figure 1:
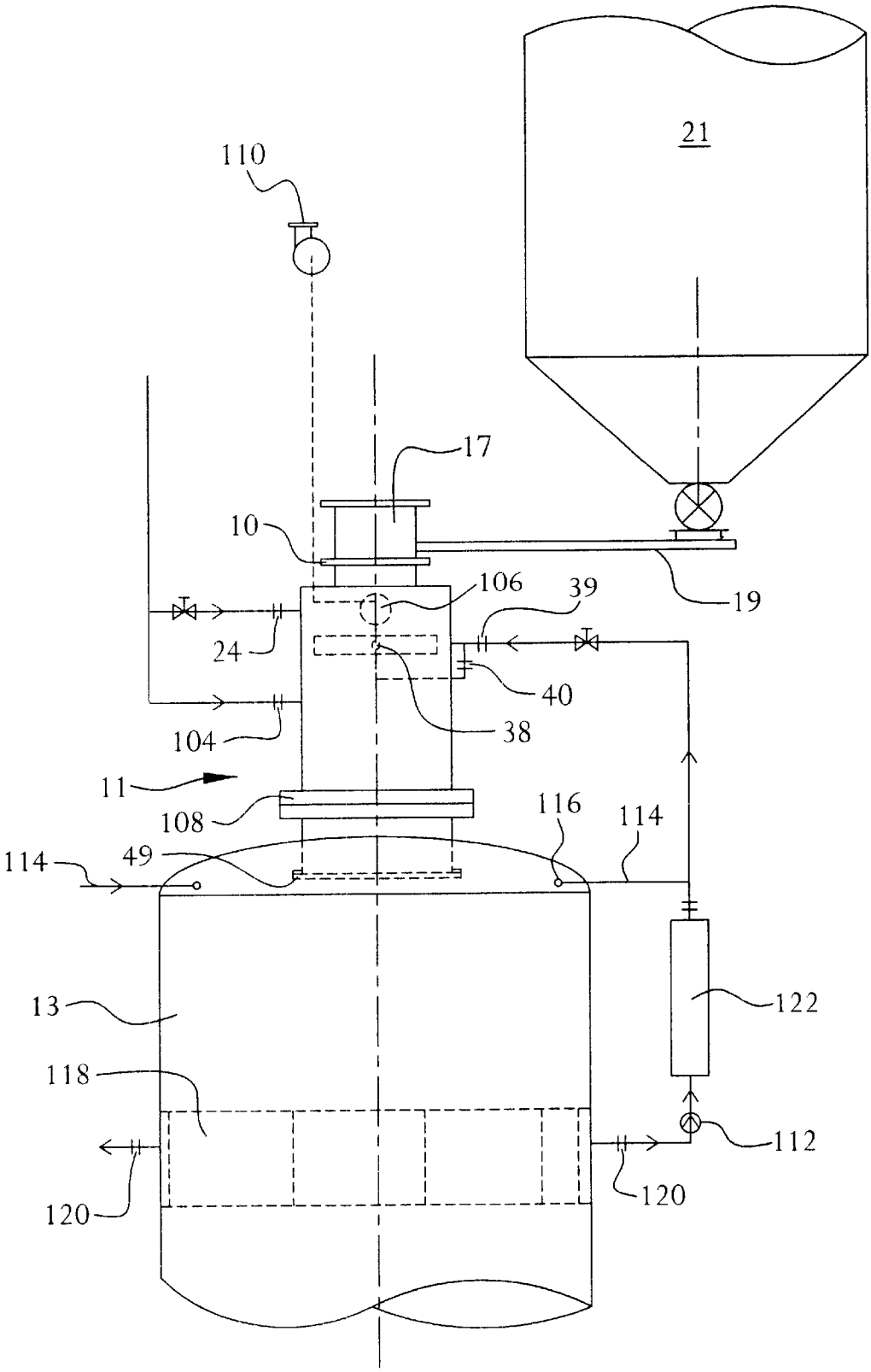
FIG. 1 is a schematic view of one form of digester including a pre-treatment unit according to the invention.
Figure 2:
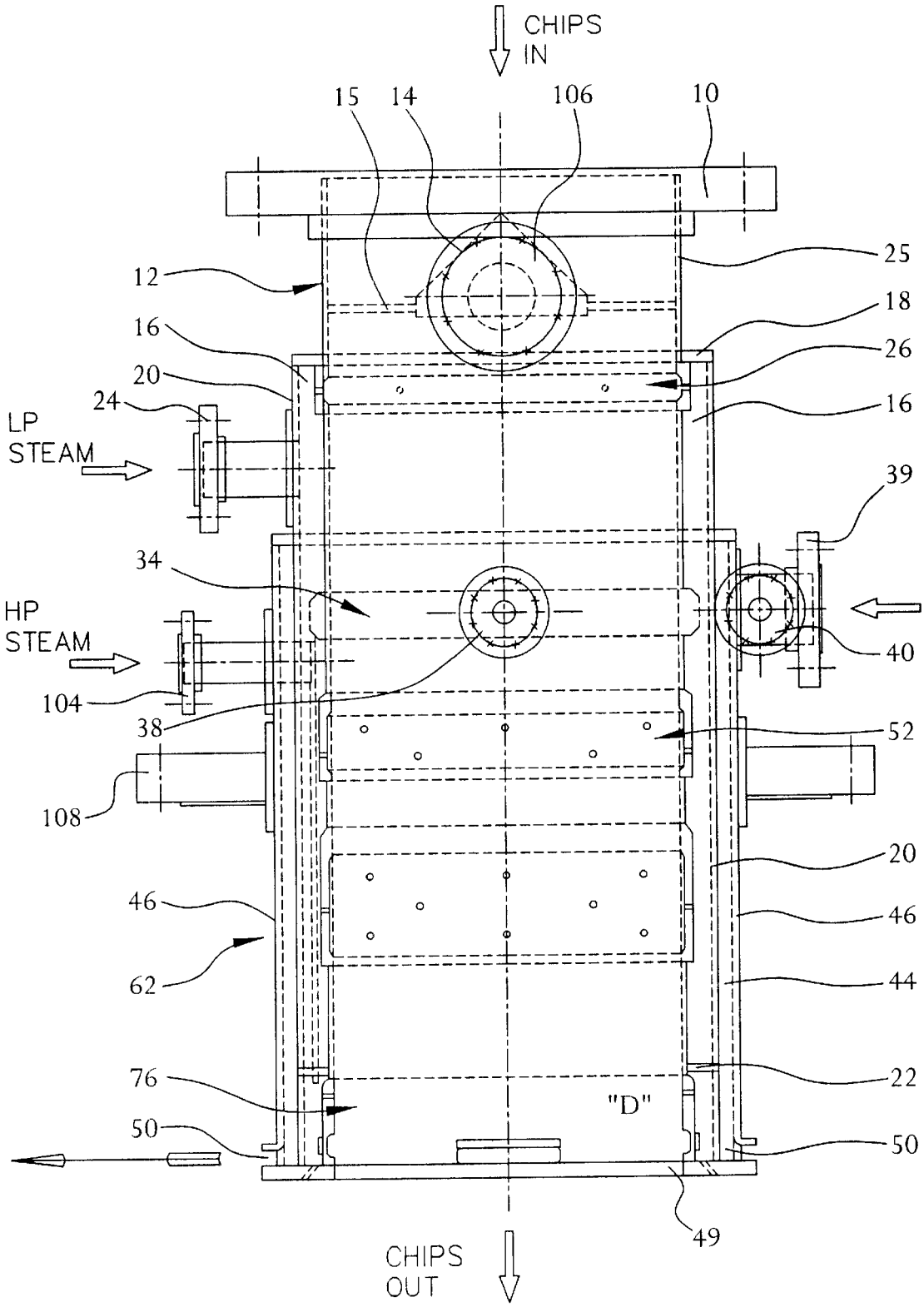
FIG. 2 is a longitudinal cross-sectional view of one form of the pre-treatment unit shown in FIG. 1.
Figure 3:
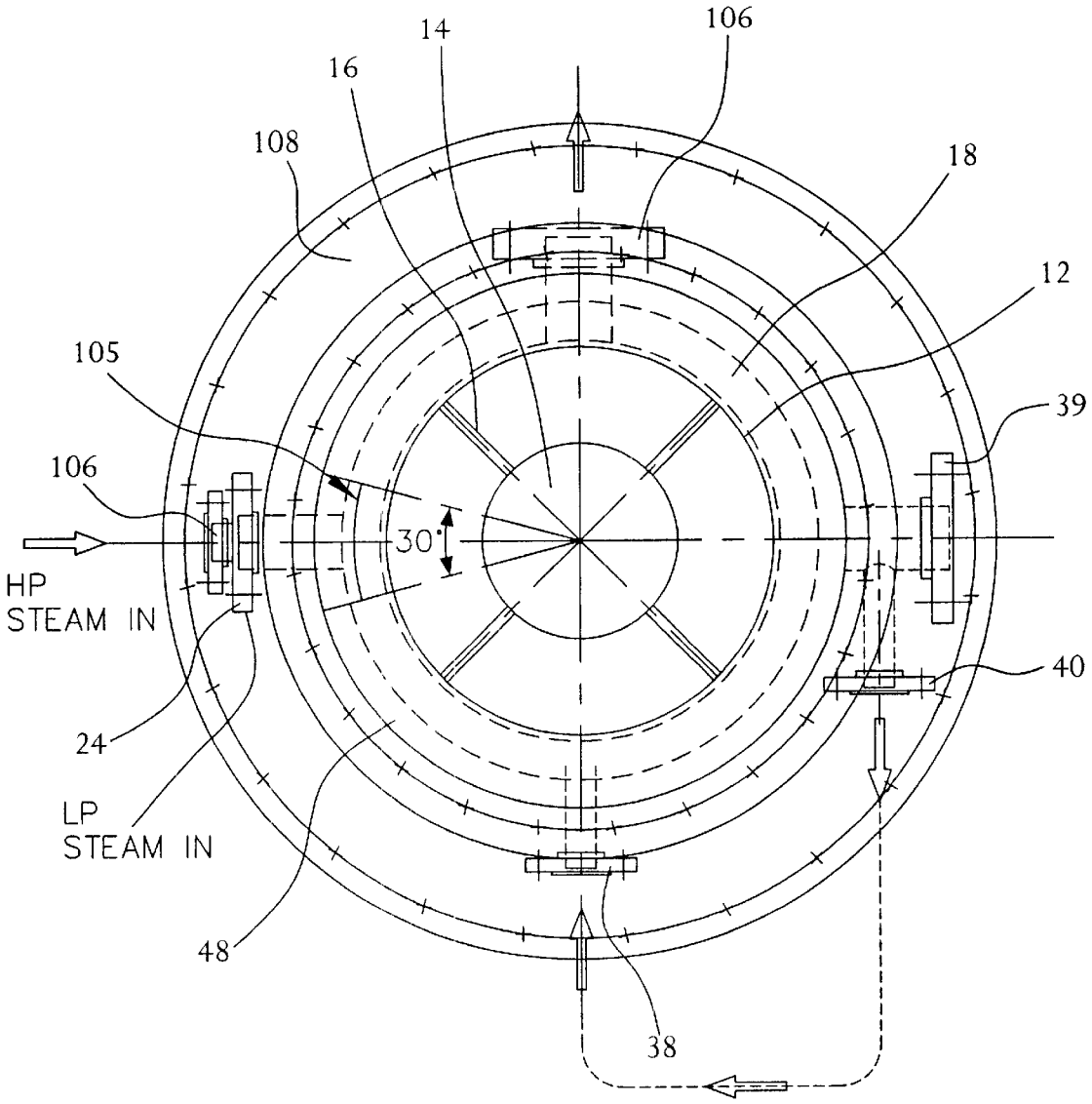
FIG. 3 is a top plan view of the pre-treatment unit shown in FIG. 2.

Referring to the drawings, and initially to FIGS. 1 to 3, a pre-treatment unit, indicated generally by the reference numeral 11, is mounted on top of a digester 13.

At the upper end of the pre-treatment unit is a flange 10. In use, the flange 10 is connected to a capping valve 17 at the outlet of a chip conveying system 19 that discharges wood chips from a chip bin 21 into the pre-treatment unit. The underside of the flange 10 is fixed to the top of an inner shell 12, which is open at the top within the flange 10. In the central part of the inner shell 12 is a conical baffle 14, with its vertex upwards, supported by a spider 15 attached between the conical baffle 14 and the inside of the inner shell 12.

Below the baffle 14, the inner shell 12 is surrounded by a steam chamber 16, formed by a top end cover 18, a middle shell 20, and a lower end ring 22. In use, a steam port 24 supplies steam to the steam chamber 16.

Figure 4:
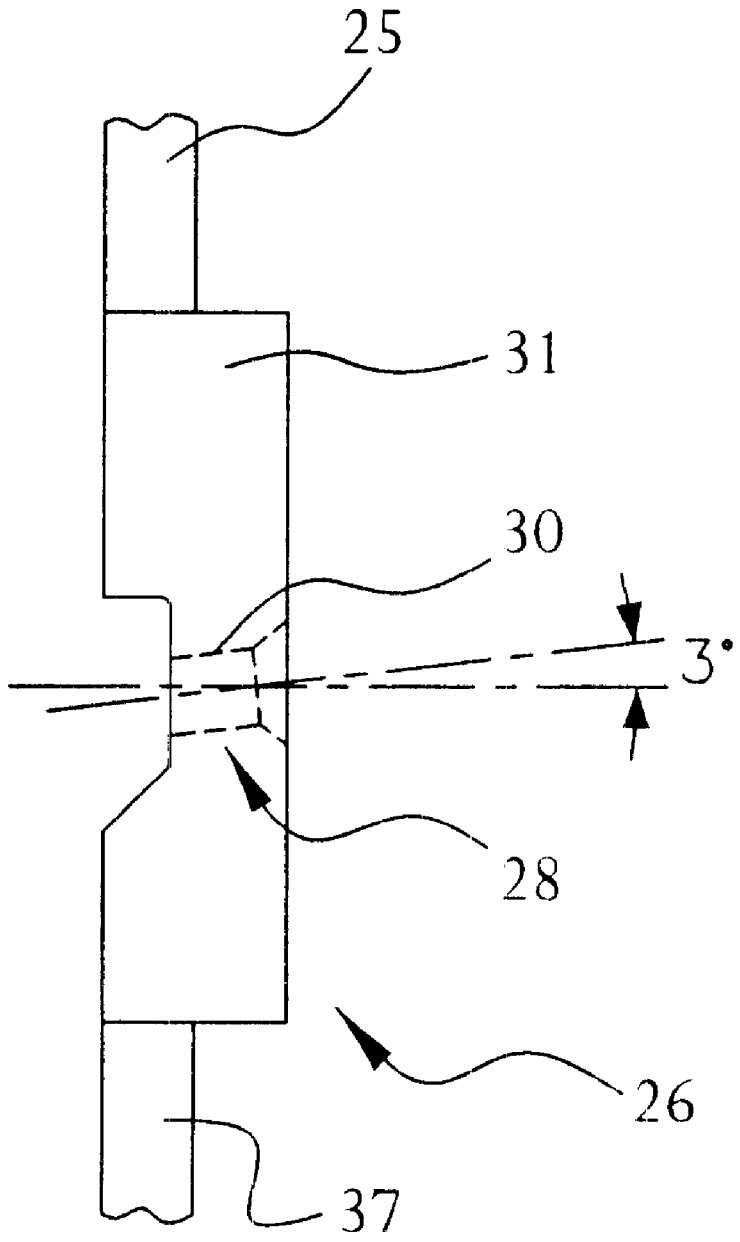
FIG. 4 is a somewhat schematic sectional view through a first steam injector forming part of the pre-treatment unit shown in FIG. 2.

A first wall portion 25 of the inner shell 12 connects the top flange 10 to a first steam injector indicated generally by the reference numeral 26, comprising a ring of six evenly-spaced steam nozzles 28 (see FIG. 4). As shown in FIG. 4, each nozzle 28 consists essentially of a circular bore 30 through a thicker wall portion 31 of the inner shell 12. The bores 30 are angled 3° downwards and 40° anticlockwise towards the inner end. The outer end of each bore 30 is countersunk with a cone half-angle of 30°. The inner ends of the bores 30 open into a groove 32, cut into the wall portion 31. The lower face 33 of the groove 32 is beveled at 45°, so that falling material will not pile up on it.

Figure 5:
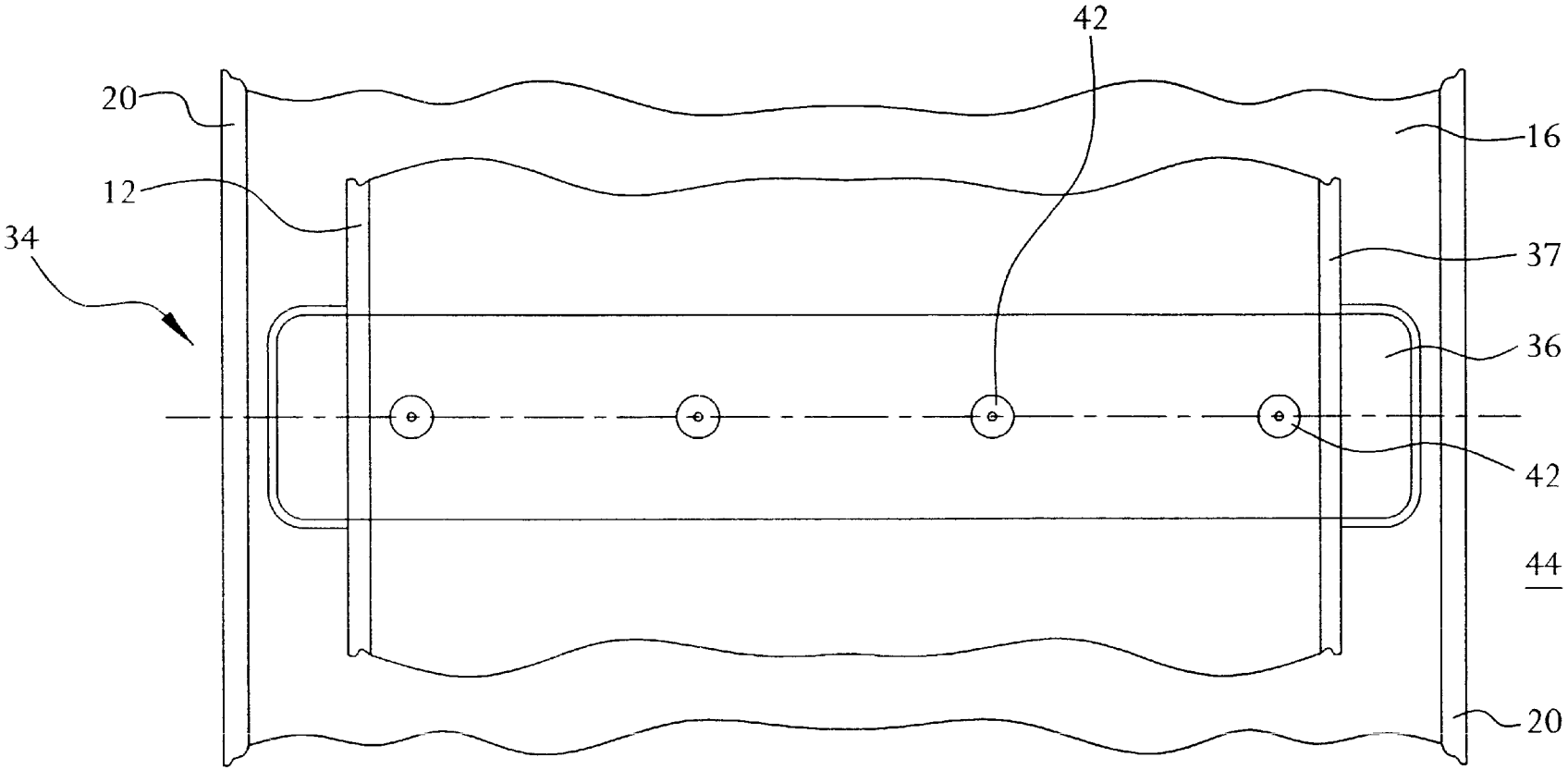
FIG. 5 is a somewhat schematic sectional view through a liquor spray area forming part of the pre-treatment unit shown in FIG. 2.

Below the first steam injector 26 is a liquor spray area indicated generally by the reference numeral 34. As shown in FIG. 5, the liquor spray area 34 comprises an annular manifold 36 surrounding a wall portion 37 of the inner shell 12, but not closing off the steam chamber 16. In use, hot liquor is supplied to the treatment unit through an inlet port 39. A side branch 40 from the inlet port 39 supplies liquor to the manifold 36 via an inlet port 38. The manifold 36 supplies eight evenly-spaced atomizer nozzles 42 that deliver a flat, atomized liquor spray into the inner shell 12. These nozzles face downward at 60° to prevent wood chips from coming into contact with the nozzle orifice. Because the atomizer nozzles 42 are constructed, rather than being formed within the material of the shell 12, a thicker wall portion is not required.

Additional liquor is delivered from the inlet port 39 to a downwardly-extending passage 44, defined by the middle shell 20 and an outer shell 46. The passage 44 is closed off by a top ring 48 above the manifold 36 and by a bottom flange 49 that forms the lower end of the pre-treatment unit. A ring of six slots 50, formed in the further shell 46 at the upper side of the bottom flange 49, allow liquor to discharge from the passage 44 into the interior of a digester.

Figure 6:
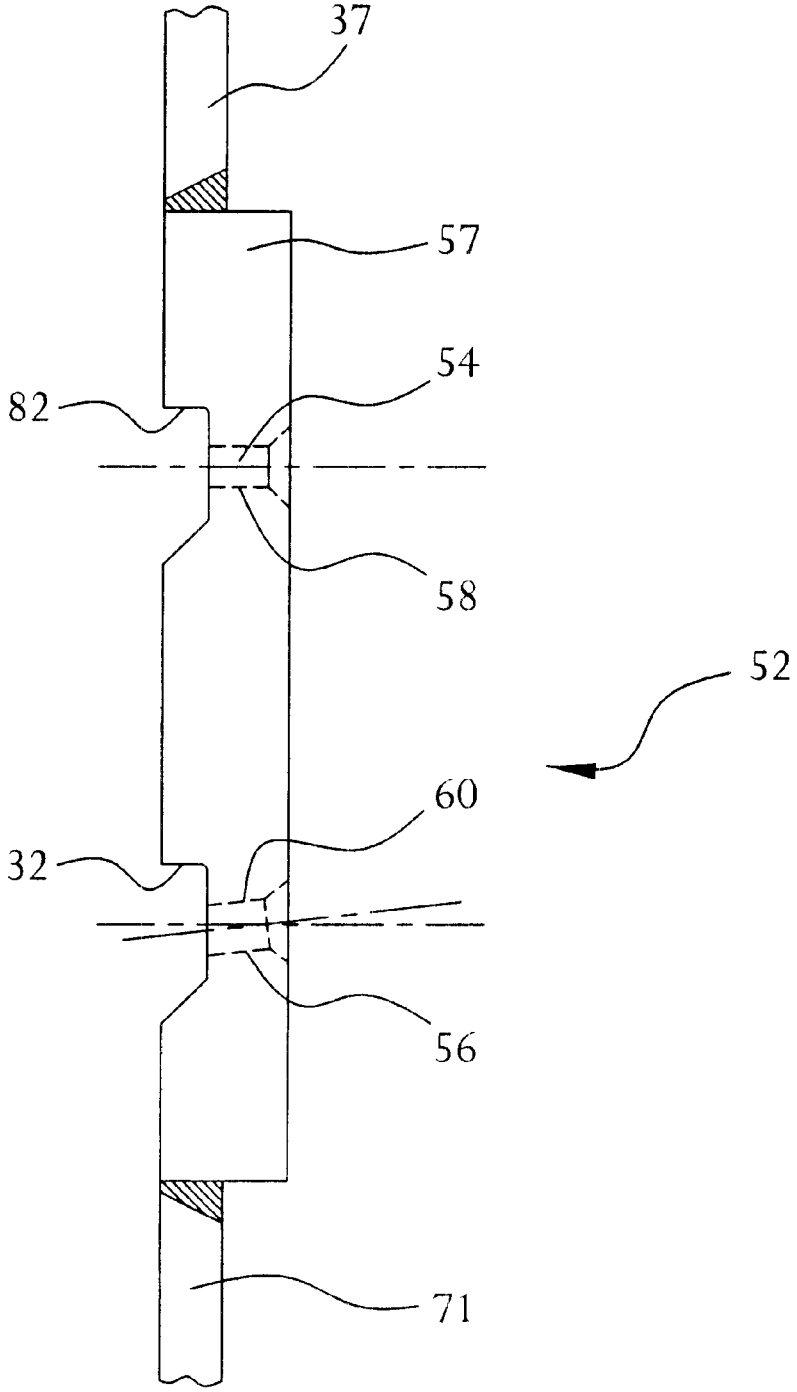
FIG. 6 is a fragmentary axial sectional view through a second steam injector forming part of the pre-treatment unit shown in FIG. 2.

Referring now to FIGS. 2 and 6, below the liquor spray area is a second steam injector, indicated generally by the reference numeral 52. The second steam injector 52 comprises two rings of six evenly-spaced steam nozzles 54 and 56 (see FIG. 6), formed in a thicker wall portion 57 of the inner shell 12. The thicker wall portion 57 is connected to the thicker wall portion 31 of the first steam injector by the thinner wall portion 37. As shown in FIG. 2, the nozzles in the two rings are offset by 30°, so that they alternate evenly round the periphery of the pre-treatment unit.

As shown in FIG. 6, each nozzle 54 or 56 consists essentially of a circular bore 58 or 60 through the inner shell 12. The circular bores 58 of the upper ring of nozzles 54 are horizontal, and the circular bores 60 of the lower ring of nozzles 56 are angled 3° downwards. The bores 58 and 60 in both rings are angled 40° anticlockwise (as seen from above) towards the inner end. The outer ends of the bores 58 and 60 are countersunk with a cone half-angle of 30°. The inner ends of the bores 54 and 56 open into grooves 32, similar to those shown in FIG. 4, the lower faces 33 of which are beveled at 45°, so that falling material will not pile up on them. The outer ends of the nozzles 54 and 56 are in communication with the steam chamber 16.

Figure 7:
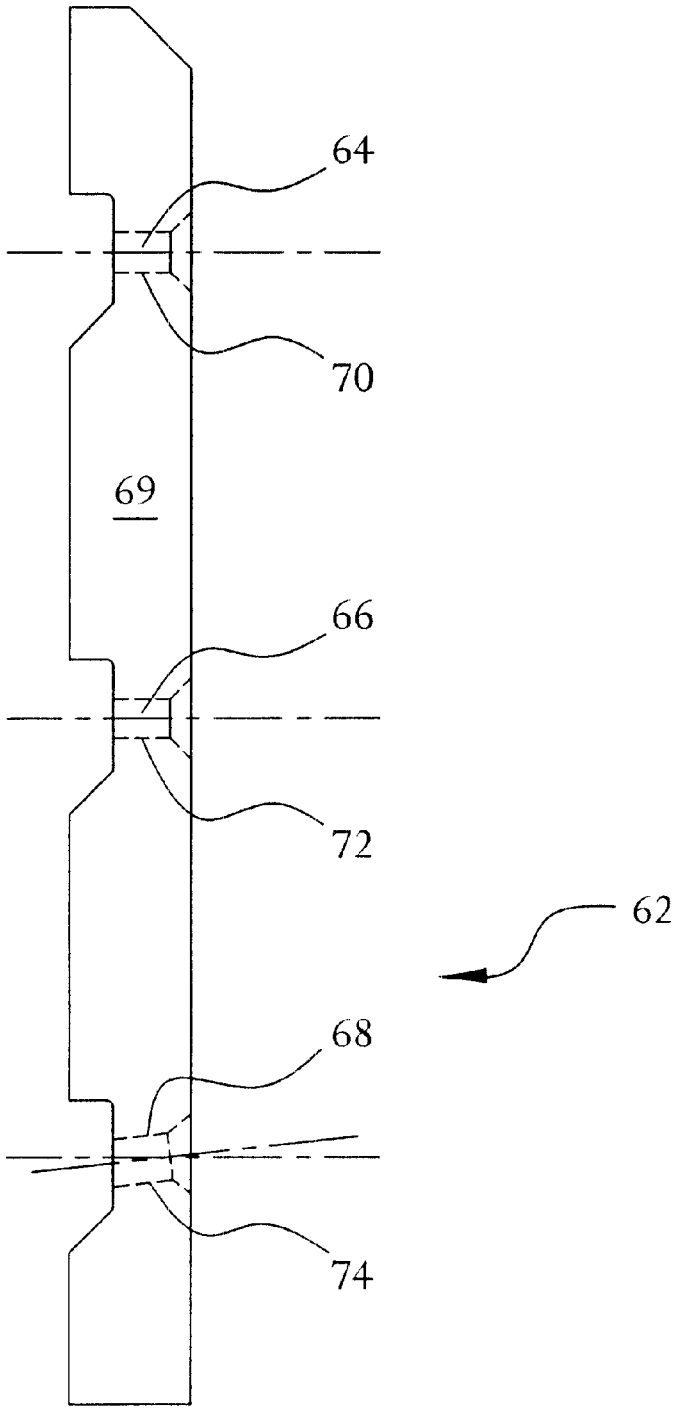
FIG. 7 is a fragmentary axial sectional view through a third steam injector forming part of the pre-treatment unit shown in FIG. 2.

Referring now to FIGS. 2 and 7, below the second steam injector 52 is a third steam injector, indicated generally by the reference numeral 62. The third steam injector 62 comprises three rings, each of six evenly-spaced steam nozzles 64, 66, and 68, formed in a thicker wall portion 69 of the inner shell 12 (see FIG. 7). The thicker wall portion 69 is connected to the thicker wall portion 57 of the second steam injector by a thinner wall portion 71. As shown in FIG. 2, the nozzles in the middle ring 66 are offset by 30° relative to the other two rings, so that the nozzles in adjacent rings alternate evenly round the periphery of the pre-treatment unit.

As shown in FIG. 7, each nozzle 64, 66, or 68 consists essentially of a circular bore 70, 72, or 74 through the inner shell 12. The circular bores 70 and 72 of the upper and middle rings of nozzles 64 and 66 are horizontal, and the circular bores 74 of the lower ring of nozzles 68 are angled 3° downwards. The bores 70, 72, and 74 in all three rings are angled 40° anticlockwise (as seen from above) towards the inner end. The outer ends of the bores 70, 72, and 74 are countersunk with a cone half-angle of 30°. The inner ends of the bores 70, 72, and 74 open into grooves 32, similar to those shown in FIG. 4. The outer ends of the nozzles 64, 66, and 68 are in communication with the steam chamber 16.

Figure 8:
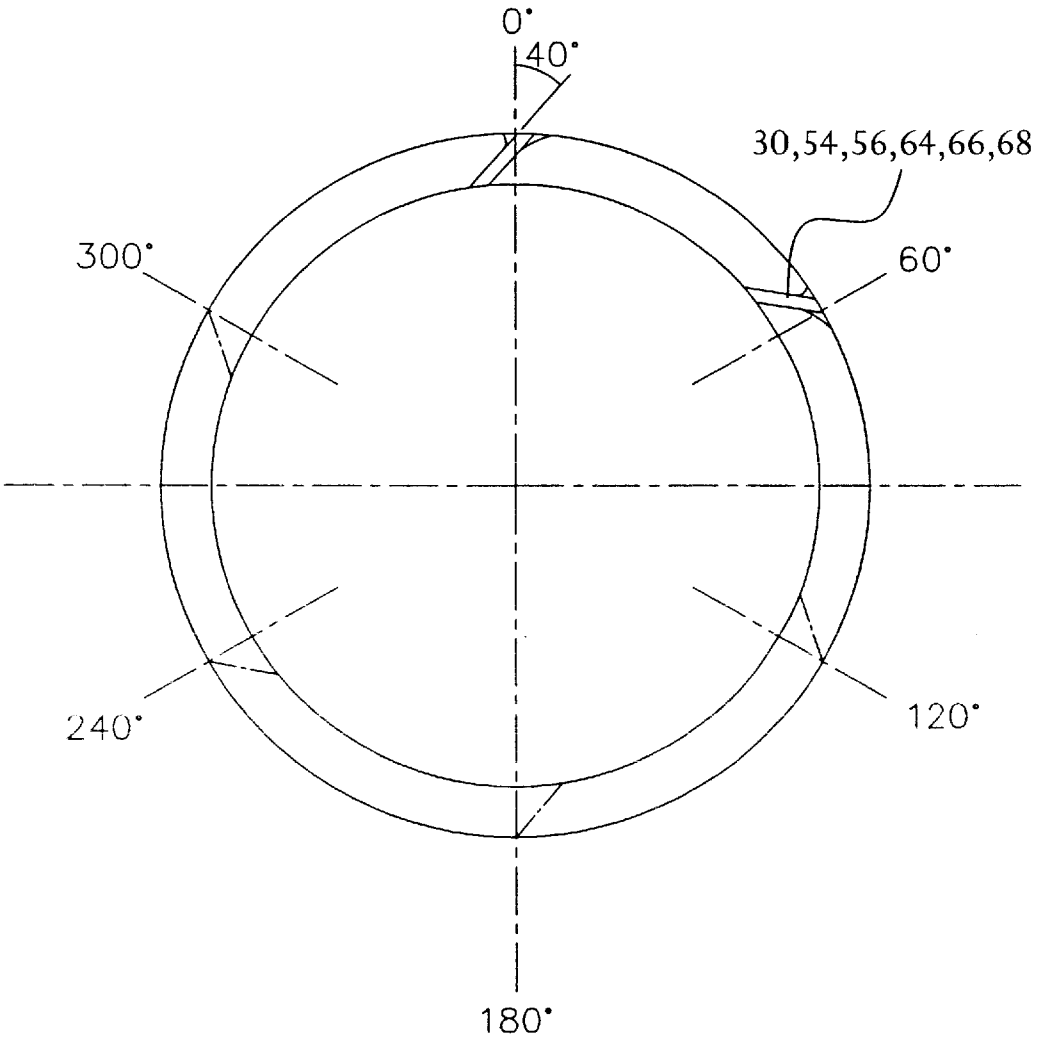
FIG. 8 is a schematic top plan view of a ring of nozzles forming part of one of the injectors shown in FIGS. 4, 6, and 7.

As may be seen from FIG. 2, the orifices in the first, second, and third steam injectors are oriented so that the orientations of the nozzles 28, 54, 56, 64, 66, and 68 are alternately staggered by 30°. FIG. 8 shows a top plan view of any of the rings of nozzles of the steam injectors 26, 52, and 62.

Figure 9:
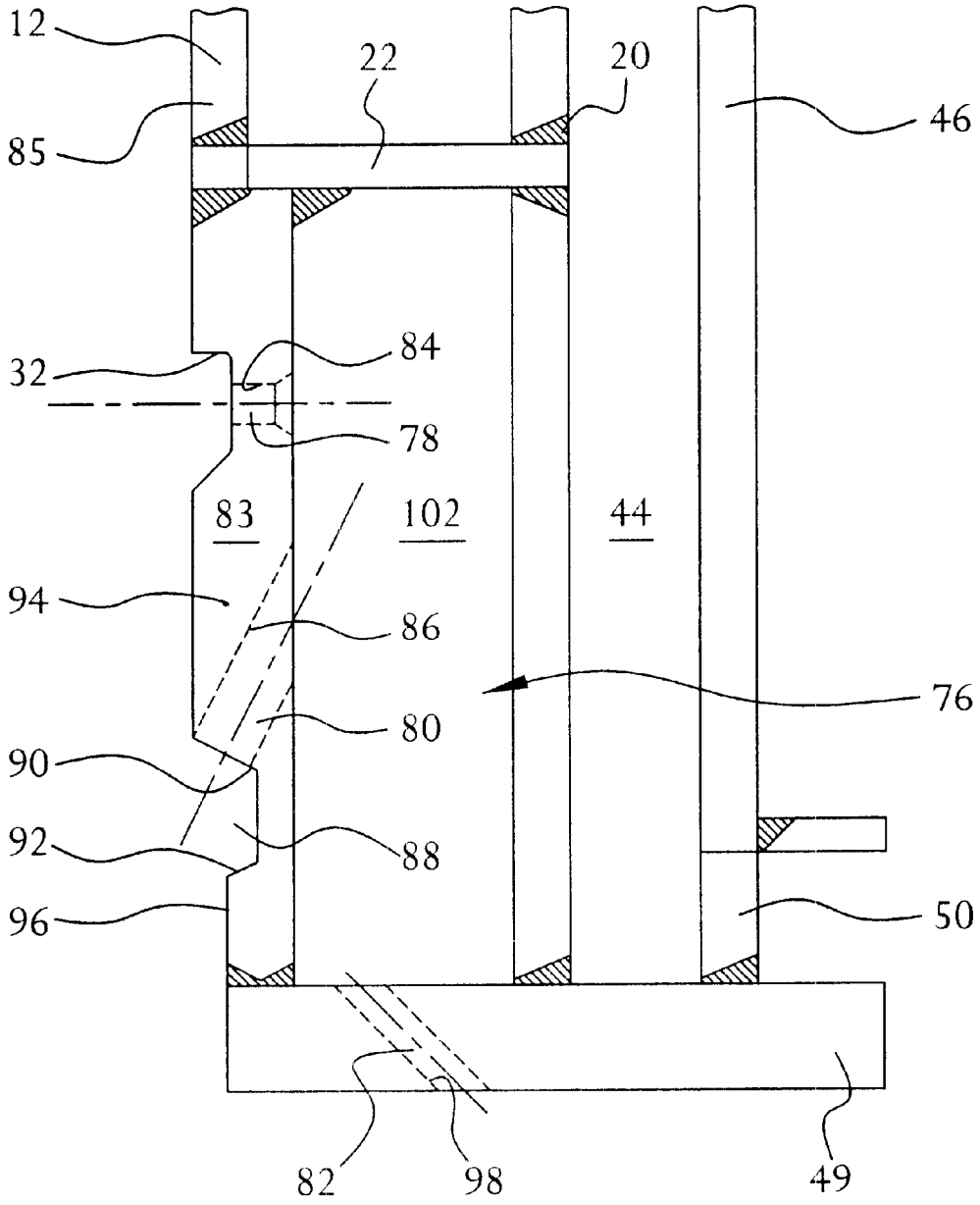
FIG. 9 is a fragmentary axial sectional view through part of a fourth steam injector forming part of the pre-treatment unit shown in FIG. 2.

Referring now to FIGS. 2 and 9, below the third steam injector 62 is a fourth steam injector, indicated generally by the reference numeral 76. The third steam injector 76 comprises three rings, each of evenly-spaced steam nozzles 78, 80, and 82 (see FIG. 8), formed in a thicker wall portion 83 of the inner shell 12. The thicker wall portion 83 extends downwards from the lower end ring 22, which is joined to the thicker wall portion 69 of the third steam injector 62 by a thinner wall portion 85. The inner axially-extending surfaces of the wall portions 25, 31, 37, 57, 71, 69, and 85, the ring 22, and the wall portion 69 are all flush with one another, so that there are no ledges on which wood chips could pile up.

The first ring of nozzles 78 of the fourth steam injector 76 consist essentially of horizontal bores 84 with countersunk outer ends and opening at their inner ends into a groove 32. They are essentially identical to the rings 54, 70, and 72, except that there are eight nozzles, spaced 45° apart, instead of six. There are eighteen nozzles 80 in the second ring, each of which consists essentially of a circular bore 86 through the inner shell 12 that is angled downwards at 30° to the vertical and 40° anticlockwise (as seen from above) towards the inner end. The inner ends of the bores 86 open into a groove 88. The upper face 90 of the groove 88 is angled at 30° to the horizontal, and the lower ends of the bores 86 open through it. The lips of the bores 86 just touch the angle between the upper face 90 and the axially-extending inner face of the wall portion 83. The lower face 92 of the groove 88 is beveled, so that falling material will not pile up on it. The part of the ring 94 below the groove 88 is set back, and is continuous with the inner periphery of the bottom flange 49 of the pre-treatment unit. This setback, together with the vertical spacing and between the upper face 90 and the lower face 92, ensures that jets of steam emerging from the bores 86 will not be substantially deflected by impinging on the lower face 92.

The third ring of nozzles 82 comprises eight bores 98 through the bottom flange 49. The upper ends of the bores 98 are between the wall shell 12 and the wall 20, and the bores angle 45° downwards and 45° clockwise towards their outer ends.

The steam chamber 16 is closed off at the top of the fourth steam injector 76 by the lower end ring 22, defining below it a separate steam manifold 102, which is supplied from a separate steam inlet 104 (see FIG. 2) above the third steam injector 62, via a steam duct 105 within the liquor passage 44. The steam duct 105 occupies approximately half of the radial width of the liquor passage 44, over a circumferential arc of 30°, and is positioned circumferentially so as not to interfere with the liquor supply to any of the slots 50.

An exhaust outlet 106 is provided near the upper end of the pre-treatment unit to discharge non-condensable gases from the unit, and from a digester on which the unit may be mounted. A control valve (not shown) is attached to the exhaust outlet 106, which may be opened and closed as required to vent air, water vapor, and other gases. The control valve may be of conventional design, construction, and operation and, in the interests of conciseness, is not further described here.

A flange 108 encircles the pre-treatment unit, about the level of the third steam injector. In use, the pre-treatment unit is mounted with the flange 108 on a chip inlet flange that is mounted around the inlet opening at the top of the digester 13. The pre-treatment unit then closes the top opening of the digester. That portion of the pre-treatment unit below the flange 108 then extends downward into the digester 13.

The digester may be conventional and, in the interests of conciseness, is not described in detail. At the beginning of operation of the digester, the conveyor system 19 conveys chips to the digester where chips fall through the capping valve 17 and through the pre-treatment unit into the digester 13.

Immediately before the first chips start to enter the digester 13, an exhaust fan 110 (see FIG. 1) starts operating. The exhaust fan 110 draws off air, gas, or vapor through the exhaust outlet 106 to maintain a 0 psi pressure within the digester during the fill period. (All pressures are relative to ambient atmospheric pressure, taken as zero.) Pressure within the pre-treatment unit varies between 0 psi and a slight negative pressure during the digester fill cycle. At the same time, steam is supplied to the steam inlet 104, and at lower pressure to the steam inlet 24. When the steam has been flowing steadily for a few seconds, the chips start entering the pre-treatment unit.

As the chips enter the pre-treatment unit, the conical baffle 14 diverts some of the incoming chips toward the inside of the inner shell 12. Diverting some chips toward the wall of the inner shell 12 allows the chips to be entrained immediately in the high velocity steam discharge from the first steam injector 26.

As the chips fall through the pre-treatment unit, steam is injected into this stream through the nozzles of the four steam injectors. When chips in the digester have built up to a certain level, circulation of liquor through the manifold 36 via the inlet port 38 and the outlet port 40 starts. Atomized liquor is then sprayed into the falling chips through the nozzles 42, and additional liquor is poured into the digester through the slots 50. The chips then fall through a fine spray of liquor. The liquor is typically a strong alkaline solution. The composition of the liquor varies depending on the requirements of a particular mill for the pulp from the digester. The selection and formulation of suitable liquors are well known in the art and, in the interests of conciseness, will not be further described here.

Chips fall freely from the conveyor into the first steam injector 26. The nozzles 28 of the first steam injector 26 discharge saturated steam into the downward flowing chips. The angle of the nozzles 28 creates both a downward thrust and a highly turbulent circular motion within the wood chips. This hot, high-speed turbulent steam atmosphere is highly conducive to heat transfer. The bores 30 in the first steam injector 26 are larger than those in the other steam injectors, to promote a high speed and assure downward flow of the chips passing through the center tube defined by the shell 12.

The chips leave the first steam injector 26 and enter the liquor spray area 34. The atomized liquor spray from the nozzles 42 coats each chip with liquor. This action enhances both heat transfer and wood chip impregnation by liquor to start the digestion process.

The liquor manifold 36 is in direct contact with the saturated steam in the steam chamber 16, which further heats the liquor for processing purposes.

Liquor is supplied to the manifold at a temperature of 200° F. to 210° F. (92° C. to 99° C.), which is increased by a higher steam temperature surrounding the liquor manifold.

After the chips pass through the liquor manifold 34, they flow downward into the second steam injector. The horizontal nozzles 54 in the top row provide heating and turbulence without a downward thrust. This orifice alignment allows an increase in chip retention time while passing these orifices. Because these orifices are angled circumferentially, they maintain a circular as well as a turbulent motion. Chips fall downward to the lower row of nozzles 56, from which steam again impacts upon the chips. The downward angle of the nozzles imparts a downward thrust, and reduces any tendency of the chips to jam in the pre-treatment device.

The chips continue to fall downward, leaving the second steam injector 52, and enter the third steam injector 62. The orifices 70 and 72 in the top two rows, which are horizontal but angled circumferentially, maintain both turbulence and circular motion.

The downwardly-angled orifices 68 in the third row create a downward thrust as well as a turbulent, circular motion of the chips, which tends both to enhance heating of the chips and to encourage the downward movement of the chips from the third steam injector 62 and into the fourth steam injector 76.

The top row of nozzles 78 of the fourth steam injector 76, like the nozzles 56, 66, and 68, create a downward, turbulent, circular motion. The second set of orifices 80, which are more steeply angled downwards, generate a downward thrust, tending to ensure that the wood chips are compacted in the digester.

The outwardly-angled third row of nozzles 82 are designed to impact with high pressure steam upon those wood chips thrown outward upon leaving the pre-treatment unit. Some chips which are traveling at a highly circular motion will spread outward when leaving the confines of the inner tube 12. As the chips are thrown outward, by the centrifugal forces resulting from the circular motion generated by the angled jets of steam, they pass beneath the nozzles 82. With high velocity steam discharging from the nozzles 82, the chips are thrown outward toward the outer diameter of the digester. This action tends to assure a more uniform filling of the digester with wood chips discharging from the pre-treatment unit.

The chips falling through the pre-treatment unit are heated to 212° F. to 220° F. (100° to 105° C.) by the action of the steam. Upon exiting, the chips are thrust downward into the digester. When the digester is filled, hot liquor is circulated to cook the chips. The liquor is circulated within the digester by pumps 112, pipes 114 and nozzles 116, and is drawn from the digester through screens 118 and outlet ports 120 by the pumps 112 for recirculation. A heat exchanger 122 heated by steam maintains the circulating liquor at a desired temperature. All of these components for circulating the liquor within the digester may be conventional and, in the interests of conciseness, are not further described here. In accordance with the present invention, part of the hot liquor from the heat exchanger 122 is directed to the inlet port 39 of the pretreatment unit.

At this point the exhaust fan 110 is shut off and the exhaust valve 106 and the capping valve 17 close, allowing pressure to rise in the digester. At the same time, the supplies of steam to the pre-treatment unit are shut off. The chips in the digester are cooked and reduced to pulp in a generally conventional manner. During the cooking cycle, the exhaust valve 106 opens up as needed to exhaust non-condensable gases and to regulate the pressure within the digester. At the finish of the cooking cycle, a bottom valve opens, and the pressure within the digester blows the pulp from the digester.

As the wood chips pass through the pre-treatment unit, it is possible to accomplish various functions to enhance both the quality and economy of creating wood pulp. Incorporated in the design of this unit are four distinct features which are advantageous in processing wood chips into pulp.

Wood chips passing through the pre-treatment unit can be brought to a temperature of 212° F. to 220° F. (100° C. to 105° C.) to release air, entrained water vapor and other non-condensables from the wood chips before the chips enter the digester. It has been established that wood chips entering the digester at the optimum temperature can be substantially free of air, water vapor and non-condensables.

Without the non-condensable gases, wood chips more thoroughly absorb liquor within the digester. It is believed that the resultant pulp can provide a better, stronger paper, and that this is because of the complete saturation of the wood chip with liquor. Preheating of the chips can also result in significant energy savings and in a more rapid cooking of the chips within the digester.

The spray nozzles 42, by pre-coating the chips with hot liquor, begin the impregnation of the chips and consequent delignifying digestion of the wood chips before the chips even enter the digester, which can also reduce the cooking time.

The chips falling through the pre-treatment unit are impacted and propelled by a large volume of high pressure, high velocity steam. This action drives the chips at high velocity into the digester, which results in compacting chips in the digester. Compacting may increase the total tonnage of each batch being cooked by 15% to 18% compared with conventional loose filling of the digester, which can both reduce the cost per ton of chips and increase pulp production in each 24 hour period.

Steam may be supplied at 100 psi (700 kPa) to the high pressure steam inlet 104, and saturated steam at a pressure of 30 psi (200 kPa) and a 10 temperature of 337.90° F. (175° C.) may be supplied through the low pressure steam inlet 24 to the steam chamber 16. Steam then emerges from the large-bore nozzles 28 of the first steam injector 26 at 1399.42 ft./sec. (425 m/s). All of the first, second, and third steam injectors 26, 52, and 62 are injecting steam into the chips at 30 psi (200 kPa) within the steam chamber 16, with a calculated discharge pressure, out of the nozzles, of 16.50 psi (110 kPa).

The high-pressure steam from the inlet 104 is discharged through the outwardly-slanting nozzles 82 of the fourth steam injector at 1400 ft./sec. (425 m/s).

The pre-treatment unit in accordance with the present invention may be used with any sort of wood chips that may be processed to pulp in digesters. It may also be used with other forms of particulate material that require treatment with hot liquid and/or steam or other vapor or gas.

The present invention may be embodied in other specific forms without departing from the spirit or essential attributes thereof and, accordingly, reference should be made to the appended claims, rather than to the foregoing specification, as indicating the scope of the invention.

For example, the number and size of the steam injectors, along with the required length of the pre-treatment unit, will vary depending upon each application. These quantities may be determined by the person skilled in the art having regard to the requirements of the particular application.

What is claimed is:

1. A pre-treatment unit for wood-chips being filled into a digester, the unit comprising:

a tube having an inlet for chips at an upper end and an open lower end forming an outlet for pre-treated chips; and at least one ring of injector nozzles in said tube, arranged in use to admit into said tube flows of gas or vapor angled circumferentially to impart a rotating motion to said chips;

said unit arranged to permit said chips to fall freely from said inlet to and through said outlet while being exposed to said gas or vapor.

2. The pre-treatment unit of claim 1, further comprising at least two said rings of nozzles, said nozzles in at least one said ring being horizontal and said nozzles in at least one said ring being angled to impart a downward motion to said gas or vapor and thereby to said chips.

3. The pre-treatment unit of claim 2, further comprising a plurality of injectors spaced apart along the height of the unit, each said injector comprising at least one said ring of nozzles, and wherein a lowest ring of nozzles of each said injector that has another said injector below it comprises downwardly angled nozzles and an uppermost ring of nozzles of each said injector that has another steam injector above it comprises horizontal nozzles.

4. The pre-treatment unit of claim 1, further comprising a ring of expulsion nozzles opening through said tube below said at least one ring of nozzles, and arranged to admit to said tube jets of gas or vapor angled downwards and circumferentially to propel said chips out of the outlet of said unit with a circumferential motion such that said chips tend to spread outwards from said outlet by circumferential force.

5. The pre-treatment unit of claim 4, further comprising a supply of gas or vapor at a first pressure to said at least one ring of injector nozzles, and a supply of gas or vapor at a second pressure higher than said first pressure to said ring of expulsion nozzles.

6. The pre-treatment unit of claim 1, further comprising a ring of dispersion nozzles opening through a bottom end face of said unit encircling said outlet, and arranged to emit jets of gas or vapor angled radially outwards and circumferentially to propel said chips outwards away from said outlet with a circumferential motion such that said chips tend to spread outwards from said outlet by circumferential force.

7. The pre-treatment unit of claim 6, further comprising a supply of gas or vapor at a first pressure to said at least one ring of injector nozzles, and a supply of gas or vapor at a second pressure higher than said first pressure to said ring of dispersion nozzles.

8. The pre-treatment unit of claim 1, adapted to supply steam through said nozzles.

9. The pre-treatment unit of claim 1, further comprising a ring of nozzles arranged to spray liquor onto said chips.

10. The pre-treatment unit of claim 9, further comprising at least two said rings of injection nozzles, and wherein said ring of liquor spray nozzles is disposed between two said rings of injection nozzles.

11. The pre-treatment unit of claim 9, further comprising outlets for said liquor at the lower end of said unit.

12. The pre-treatment unit of claim 1, further comprising a baffle disposed within said inlet, said baffle having at least one sloped surface disposed to deflect at least some chips entering said unit towards the wall of said tube.

13. The pre-treatment unit of claim 12, further comprising at least one said ring of injection nozzles disposed in the vicinity of said baffle and arranged to impart a rotary movement to said chips deflected by said baffle.

* * * * *